US008757767B2

(12) United States Patent
Inoue

(10) Patent No.: US 8,757,767 B2
(45) Date of Patent: Jun. 24, 2014

(54) LIQUID EJECTION APPARATUS, CLEANING APPARATUS FOR LIQUID EJECTION HEAD, AND INKJET RECORDING APPARATUS

(71) Applicant: FUJIFILM Corporation, Tokyo (JP)

(72) Inventor: Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/773,371

(22) Filed: Feb. 21, 2013

(65) Prior Publication Data

US 2013/0222476 A1 Aug. 29, 2013

(30) Foreign Application Priority Data

Feb. 23, 2012 (JP) ..... 2012-037836

(51) Int. Cl.
*B41J 2/165* (2006.01)

(52) U.S. Cl.
USPC ..... 347/33; 347/31

(58) Field of Classification Search
CPC ..... B41J 2/16535; B41J 2/16544; B41J 2002/1655
USPC ..... 347/22, 31–34, 16, 38, 101, 104
See application file for complete search history.

(56) References Cited

U.S. PATENT DOCUMENTS

2009/0009905 A1 1/2009 Kondo
2012/0026244 A1 2/2012 Inoue
2012/0038707 A1* 2/2012 Maida ..... 347/33

FOREIGN PATENT DOCUMENTS

JP 2005-022251 A 1/2005
JP 2007-030482 A 2/2007
JP 2010-234666 A 10/2010

OTHER PUBLICATIONS

The extended European Search Report issued on Jun. 14, 2013, which corresponds to EP Application No. 13156321.5-1701 and is related to U.S. Appl. No. 13/773,371.

* cited by examiner

*Primary Examiner* — Thinh Nguyen
(74) *Attorney, Agent, or Firm* — Studebaker & Brackett PC

(57) ABSTRACT

A liquid ejection apparatus includes: a liquid ejection head; a long wiping member configured to come in contact with and wipe a liquid ejection face of the head; a wiping member conveyance device configured to convey the wiping member in a lengthwise direction of the wiping member; an elastic member configured to elastically deform and apply a force to cause the wiping member to be pressed against the liquid ejection face through a pressing member when the wiping member comes in contact and pressed against the liquid ejection face; and a slack eliminating member arranged in a front side of the head in a direction of travel of the head with respect to the wiping member, the slack eliminating member being configured to eliminate slack in the wiping member caused by elastic deformation of the elastic member when the wiping member comes in contact with the slack eliminating member.

12 Claims, 12 Drawing Sheets

LIQUID EJECTION APPARATUS, CLEANING APPARATUS FOR LIQUID EJECTION HEAD, AND INKJET RECORDING APPARATUS

BACKGROUND OF THE INVENTION

1. Field of the Invention

The present invention relates to a liquid ejection apparatus, a cleaning apparatus for a liquid ejection head, and an inkjet recording apparatus, and more particularly to head cleaning technology for wiping a liquid ejection face of a liquid ejection head by means of a long wiping member, and to a liquid ejection apparatus and an inkjet recording apparatus using this technology.

2. Description of the Related Art

In an inkjet recording apparatus, with use, foreign material such as ink residue or paper dust adheres to a liquid ejection face (a nozzle face formed with nozzles) of a liquid ejection head. When the foreign material adheres to the nozzles and/or the periphery thereof, the adhering material affects ink droplets ejected from the nozzles and causes deviation in the ejection direction of the ink droplets, and it is then difficult to deposit the ink droplets at prescribed positions on the recording medium. As a result of this, the output image quality declines. Therefore, in an inkjet recording apparatus, a maintenance operation is carried out to remove foreign material adhering to the nozzle face, periodically or at a suitable timing (see, for example, Japanese Patent Application Publication Nos. 2005-022251 and 2007-030482).

Japanese Patent Application Publication No. 2005-022251 discloses a wiping unit including: a cleaning liquid supply device, which supplies cleaning liquid to a long wiping sheet (wiping member) wound in the form of a roll; and a pressing device, which presses the wiping sheet against the nozzle face of the liquid ejection head. The wiping sheet is paid out from a pay-out reel of a sheet supply unit, and is taken up onto a take-up reel through a pressing roller. By moving the pressing roller over the nozzle face while thus conveying the wiping sheet in a prescribed direction, the wiping sheet is pressed against the nozzle face and caused to rub the nozzle face, thereby wiping the nozzle face. Moreover, Japanese Patent Application Publication No. 2005-022251 proposes to provide the wiping unit with a controller configured to cause a first wiping operation of pressing the wiping sheet impregnated with the cleaning liquid against the nozzle face, and to then cause a second wiping operation of pressing a wiping sheet in a dry state against the nozzle face.

Japanese Patent Application Publication No. 2007-030482 discloses a cleaning apparatus for an inkjet head including: a supporting device, which supports a flexible cleaning device in the form of a sheet, such as a cloth or film, at a position under a lower face of a head; and a pressing device, which presses the cleaning device supported by the supporting device to the lower face of the head from below.

In Japanese Patent Application Publication No. 2005-022251, the pressing roller for pressing the wiping sheet against the nozzle face is constituted of an elastic roller formed by attaching an elastic body of rubber, or the like, to the outer circumference of a shaft (paragraph 0056 in Japanese Patent Application Publication No. 2005-022251). When the elastic roller (pressing roller) moves transversely in the region under the nozzle face, the wiping sheet and the pressing roller are compressed in the downward direction, in such a manner that the wiping sheet is pressed against the nozzle face due to an elastic restoring force of the pressing roller. However, the apparatus according to Japanese Patent Application Publication No. 2005-022251 does not include any device to manage the pressing force.

On the other hand, in Japanese Patent Application Publication No. 2007-030482, the pressing force applied to the head is adjusted by deformation of the pressing device, which deforms elastically upon the pressing action.

However, due to the deformation of the elastic member, the sheet-formed flexible cleaning device (the wiping member such as cloth or film) is distorted, and it becomes impossible to convey the cleaning device. When it becomes impossible to convey the cleaning device due to the occurrence of distortion, the wiping surface of the sheet-shaped cleaning device is not renewed, then the wiping surface having been soiled is used to wipe the head, and hence there is a problem in that the soiling becomes attached again to the nozzle face.

This issue in the related art is described here by a concrete example shown in FIGS. 12 and 13. FIGS. 12 and 13 show a liquid ejection head (hereinafter referred to as the "head") 520 and a wiping unit 630, which wipes a nozzle face 522 of the head 520. The wiping unit 630 includes: a pay-out side web core 634, which supplies a long wiping web 632; a take-up side web core 636, which takes up the wiping web 632 that has been paid out; a pressing roller 640, which presses the wiping web 632 against the nozzle face 522 of the head 520; an impelling spring 642, which impels the pressing roller 640 and the wiping web 632 wrapped thereon in the upward direction in FIGS. 12 and 13; and a pair of web driving rollers 650, which drives the wiping web 632 to be conveyed.

The wiping web 632 that has been paid out from the pay-out side web core 634 is wound up onto the take-up side web core 636 through a first guide roller 672, a second guide roller 676 and the pressing roller 640. A cleaning liquid deposition roller 662 is disposed between the first guide roller 672 and the second guide roller 676, and is configured to deposit the cleaning liquid on the wiping web 632.

In the composition shown in FIG. 12, a relative movement of the head 520 and the wiping unit 630 is carried out. Here, an example is described where the head 520 is horizontally moved from the left-hand side toward the right-hand side in the direction indicated with an arrow A in FIG. 12, but it is also possible to adopt a composition where the head 520 is stationary and the wiping unit 630 is moved from the right-hand side toward the left-hand side in the drawing.

As shown in FIG. 12, in a state before the wiping web 632 comes in contact with the nozzle face 522 of the head 520, the wiping unit 630 is arranged in such a manner that the uppermost position 638 of the wiping web 632 wrapped around the pressing roller 640 is slightly (for example, by approximately 1.5 mm) higher than the position of the nozzle face 522. When wiping the nozzle face 522, the impelling spring 642 is compressed in accordance with the height differential (the amount of overlap) between the nozzle face 522 and the uppermost position 638 of the wiping web 632, and the wiping web 632 is pressed against the nozzle face 522.

When the wiping web 612 thereby comes in contact with the nozzle face 522 while the impelling spring 622 is compressed, then as shown in FIG. 13, slacks 702 of the wiping web 632 occur on both of the upstream side and the downstream side of the pressing roller 640. For example, if there is the overlap of approximately 1.5 mm, then when the wiping web 632 comes in contact and pressed against the nozzle face 522, the slack 702 of 1.5 mm occurs in the wiping web 632 on each side of the pressing roller 640, i.e., the slacks 702 in total of approximately 3 mm occur on both the sides. In this case, when the web drive roller 650 drives the wiping web 632 at the conveyance speed of 3.2 mm/s, then a state arises in which the wiping web 632 cannot be conveyed for approximately one second between the occurrence and disappearance of the slacks 702. During this time, the nozzle face 522 is wiped with a soiled surface of the wiping web 632.

An issue of this kind is not limited to the inkjet printer, but rather is also a common problem in liquid ejection apparatuses of various kinds which use liquid ejection heads.

SUMMARY OF THE INVENTION

The present invention has been contrived in view of these circumstances, an object thereof being to provide a liquid ejection apparatus, a cleaning apparatus for a liquid ejection head, and an inkjet recording apparatus, in which head cleaning properties can be improved by suppressing slack of a long wiping member when the long wiping member comes in contact and pressed against a liquid ejection face of a liquid ejection head and caused to wipe the liquid ejection face.

In order to attain the aforementioned object, the present invention is directed to a liquid ejection apparatus, comprising: a liquid ejection head which has a liquid ejection face formed with nozzles configured to eject droplets of liquid; a long wiping member which is configured to come in contact with the liquid ejection face to wipe the liquid ejection face; a wiping member conveyance device which is configured to drive the wiping member to be conveyed in a lengthwise direction of the wiping member; a pressing member which is configured to cause the wiping member to come in contact and pressed against the liquid ejection face; an elastic member which is configured to elastically deform and apply a force to cause the wiping member to be pressed against the liquid ejection face through the pressing member when the wiping member comes in contact and pressed against the liquid ejection face; a relative movement device which is configured to cause relative movement of the liquid ejection head with respect to the wiping member that is in contact with the liquid ejection head and travels by being driven to be conveyed by the wiping member conveyance device; and a slack eliminating member which is arranged in a front side of the liquid ejection head in a direction of travel of the liquid ejection head with respect to the wiping member caused by the relative movement, the slack eliminating member being configured to eliminate slack in the wiping member caused by elastic deformation of the elastic member when the wiping member comes in contact with the slack eliminating member.

According to this aspect of the invention, the wiping member comes in contact with the slack eliminating member before coming in contact with the liquid ejection face of the liquid ejection head. The slack of the wiping member that occurs upon the contact is eliminated during the contact with the slack eliminating member, and after the slack has been eliminated, the wiping member comes in contact with the liquid ejection face. Consequently, it is possible to wipe the liquid ejection face always with a new wiping surface by successively conveying the wiping member, and hence the wiping properties can be improved.

Preferably, the slack eliminating member has a flat surface section which is arranged to form a same plane with the liquid ejection face of the liquid ejection head.

According to this aspect of the invention, the slack in the wiping member that occurs when the wiping member comes in contact with the flat surface section of the slack eliminating member is eliminated, and wiping of the liquid ejection face can be started with the wiping member in a state in which the slack has been eliminated.

Preferably, the wiping member conveyance device is configured to drive the wiping member to be conveyed to eliminate the slack when the wiping member is in contact with the slack eliminating member.

According to this aspect of the invention, the slack in the wiping member that occurs when the wiping member comes in contact with the slack eliminating member is absorbed by the conveyance driving of the wiping member during the period of contact with the slack eliminating member.

Preferably, the liquid ejection apparatus further comprises: a control device which is configured to control a drive speed of the wiping member conveyance device to drive the wiping member, wherein the control device is configured to cause the wiping member conveyance device to drive at a first drive speed when the liquid ejection face is wiped by the relative movement while the wiping member is in contact with the liquid ejection face, and is configured to cause the wiping member conveyance device to drive at a second drive speed faster than the first drive speed when the wiping member is in contact with the slack eliminating member.

According to this aspect of the invention, it is possible to reduce the used amount of the wiping member. Furthermore, since the slack can be eliminated in a relatively short period of time, it is possible to reduce the size of the slack eliminating member.

Preferably, the liquid ejection apparatus further comprises: a detection device which is configured to detect the slack, wherein the control device is configured to control the drive speed of the wiping member conveyance device in accordance with a detection signal obtained from the detection device.

According to this aspect of the invention, it is possible to further reduce the used amount of the wiping member. Furthermore, the size of the slack eliminating member can also be reduced further.

Preferably, the control device is configured to cause the wiping member conveyance device to drive at the second drive speed when the slack is detected by the detection device, and is configured to cause the wiping member conveyance device to drive at the first drive speed when the slack ceases to be detected by the detection device.

According to this aspect of the invention, by adopting the control mode based on detecting the presence or absence of the slack and driving at high speed if the slack is detected, and driving at low speed if the slack ceases to be detected, then the used amount of the wiping member can be reduced yet further. Furthermore, the size of the slack eliminating member can also be reduced further.

Preferably, the wiping member is wound around a first core on a pay-out side; and the wiping member conveyance device is configured to drive the wiping member to be paid out from the first core, to pass through the pressing member, and to be taken up onto a second core on a take-up side.

According to this aspect of the invention, the long wiping member is wound in the form of a roll around the first core, and is conveyed from the first core toward the second core through the pressing member.

Preferably, the wiping member conveyance device is configured to drive the wiping member to be conveyed in a direction opposite to a direction of the relative movement of the liquid ejection head with respect to the wiping member caused by the relative movement device.

According to this aspect of the invention, it is possible to achieve effective wiping and cleaning.

Preferably, a conveyance speed of the wiping member caused by the wiping member conveyance device is less than 1/10 of a speed of the relative movement of the liquid ejection head with respect to the wiping member caused by the relative movement device.

According to this aspect of the invention, it is possible to maintain good wiping properties, while suppressing the used amount of the wiping member.

In order to attain the aforementioned object, the present invention is also directed to a cleaning apparatus for a liquid ejection head, comprising: a long wiping member which is configured to come in contact with a liquid ejection face of a liquid ejection head to wipe the liquid ejection face, the liquid ejection face being formed with nozzles configured to eject droplets of liquid; a wiping member conveyance device which is configured to drive the wiping member to be conveyed in a lengthwise direction of the wiping member; a pressing member which is configured to cause the wiping member to come in contact and pressed against the liquid ejection face; an elastic member which is configured to elastically deform and apply a force to cause the wiping member to be pressed against the liquid ejection face through the pressing member when the wiping member comes in contact and pressed against the liquid ejection face; and a slack eliminating member which is arranged in a front side of the liquid ejection head in a direction of travel of the liquid ejection head with respect to the wiping member to wipe the liquid ejection face caused by relative movement of the liquid ejection head with respect to the wiping member that is in contact with the liquid ejection head and travels by being driven to be conveyed by the wiping member conveyance device, the slack eliminating member being configured to eliminate slack in the wiping member caused by elastic deformation of the elastic member when the wiping member comes in contact with the slack eliminating member.

In this aspect of the invention, it is possible to combine the composition described in any of the above-described aspects of the invention.

In order to attain the aforementioned object, the present invention is also directed to an inkjet recording apparatus, comprising: a liquid ejection head which has a liquid ejection face formed with nozzles configured to eject droplets of liquid; a medium conveyance device which is configured to convey a recording medium on which the droplets ejected from the liquid ejection head are deposited; the above-described cleaning apparatus; and a relative movement device which is configured to cause the relative movement of the liquid ejection head with respect to the wiping member that is in contact with the liquid ejection head and travels by being driven to be conveyed by the wiping member conveyance device.

In this aspect of the invention, it is possible to combine the composition described in any of the above-described aspects of the invention.

Preferably, a plurality of the liquid ejection heads are arranged in a conveyance path of the recording medium, and the cleaning apparatus is arranged for each of the liquid ejection heads.

According to this aspect of the invention, it is possible to wipe each of the liquid ejection heads in a satisfactory manner. In this aspect of the invention, the "relative movement device" can be a common relative movement device which causes the relative movement of the plurality of heads simultaneously.

According to the present invention, the slack eliminating member is arranged in the front side of the liquid ejection head in the direction of travel caused by the relative movement, and the wiping member comes in contact with the slack eliminating member before coming in contact with the liquid ejection face of the liquid ejection head, due to the relative movement of the relative movement device. When the wiping member comes in contact and pressed against the slack eliminating member with the pressing member, the elastic member deforms elastically, and slack occurs in the wiping member, but this slack is eliminated while the wiping member is in contact with the slack eliminating member. After the slack in the wiping member has been eliminated by the slack eliminating member, it is possible to wipe and clean the liquid ejection face by bringing the wiping member into contact with the liquid ejection face of the liquid ejection head.

According to the present invention, it is possible to suppress the slack of the wiping member which wipes the liquid ejection face of the liquid ejection head, and wiping properties can be improved. Therefore, it is possible to maintain and improve the ejection characteristics of the liquid ejection head and stable droplet ejection becomes possible.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

First Embodiment

Figure 1:
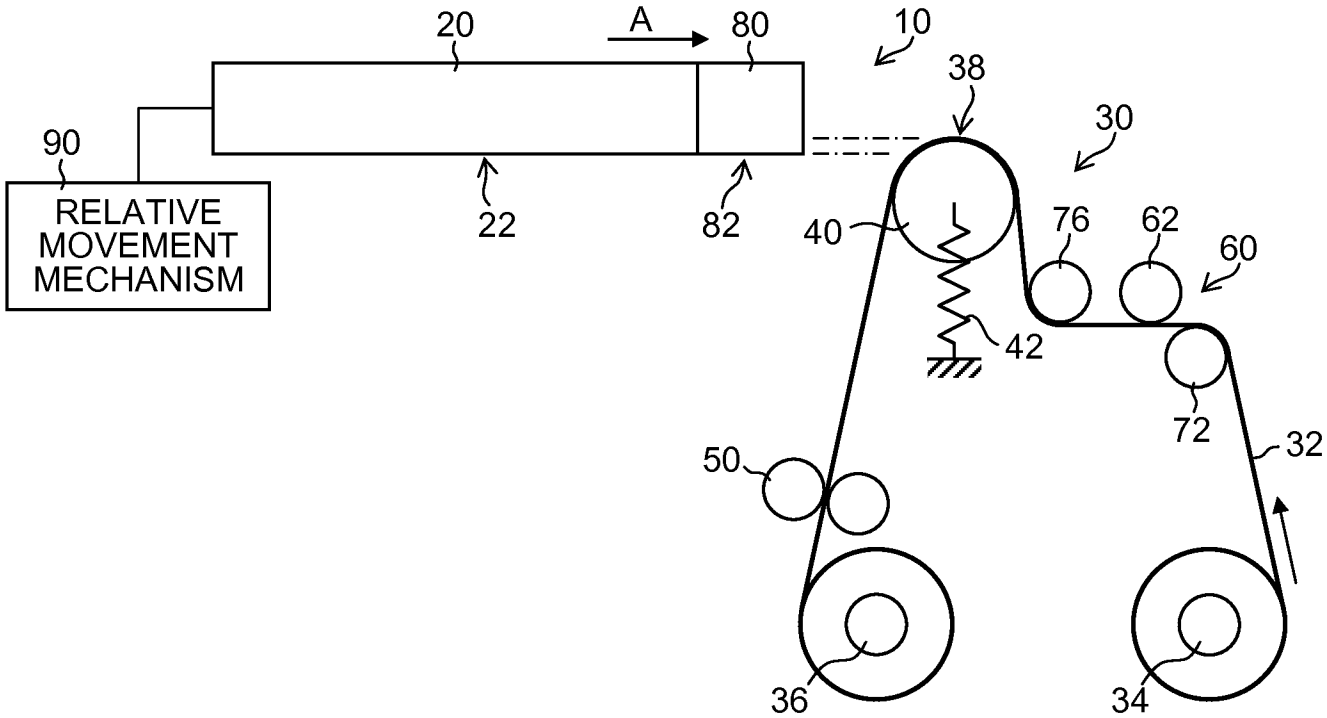
FIG. 1 is a schematic drawing showing a composition of a liquid ejection apparatus according to a first embodiment of the present invention.

FIG. 1 is a schematic diagram showing a composition of a liquid ejection apparatus 10 according to a first embodiment of the present invention. As shown in FIG. 1, the liquid ejection apparatus 10 includes: a liquid ejection head (hereinafter referred to as the "head") 20; a wiping unit 30, which wipes and cleans a nozzle face 22 (corresponding to a "liquid ejection face") of the head 20; and a slack eliminating member 80, which is arranged on a lateral side of the head 20.

The wiping unit 30 includes: a pay-out side web core 34 (corresponding to a "first core"), which supplies a long wiping web 32 (corresponding to a "wiping member"); a take-up side web core 36 (corresponding to a "second core"), which takes up the wiping web 32 paid out from the pay-out side web core 34; a pressing roller 40 (corresponding to a "pressing member"), which is arranged in a web conveyance path from the pay-out side web core 34 to the take-up side web core 36 so that the wiping web 32 is wrapped around the pressing roller 40 to come in contact and pressed against the nozzle face 22 of the head 20; an impelling spring 42 (corresponding to an "elastic member"), which impels the pressing roller 40 in the upward direction in FIG. 1 (in a direction pressing the pressing roller 40 toward the nozzle face 22 of the head 20 during wiping); and a pair of web drive rollers 50, which drives the wiping web 32 to be conveyed.

Furthermore, the liquid ejection apparatus 10 includes a relative movement mechanism 90 (corresponding to a "relative movement device"), which causes relative movement of the head 20 with respect to the wiping unit 30. Here, the embodiment is described in which the head 20 is moved in parallel to the wiping unit 30 from the left-hand side toward the right-hand side in the direction indicated with an arrow A in FIG. 1, but the method of relative movement is not limited to this.

For instance, it is also possible to adopt a composition where the head 20 is stationary and the wiping unit 30 is moved from the right-hand side toward the left-hand side in FIG. 1 (in the direction reverse to the direction of the arrow A), or a composition where both of the head 20 and the wiping unit 30 are moved in mutually opposing directions.

The wiping web 32 is, for example, constituted of a knitted or woven sheet made of ultra-fine fibers of polyethylene terephthalate (PET), polyethylene (PE), nylon (NY), or the like, and is formed in a band shape having the width corresponding to the width of the nozzle face 22 of the head 20 to be wiped. The wiping web 32 is supplied in a state of being wound in the form of a roll around the pay-out side web core 34, the front end of the web being fixed to the take-up side web core 36.

One end of the pay-out side web core 34 is fitted on a pay-out spindle (not shown), which is supported horizontally. The pay-out spindle has a dual-tube structure, in which an outer tube is supported rotatably about the periphery of an inner tube. A reverse locking mechanism and a friction mechanism are arranged between the inner tube and the outer tube, and the outer tube can rotate only in one direction (the pay-out direction of the wiping web 32; the counter-clockwise direction in FIG. 1) with a uniform resistance.

The take-up side web core 36 is fitted onto a take-up spindle (not shown), which is supported horizontally and rotatably. The take-up spindle can rotate in one direction (the take-up direction of the wiping web 32; the counter-clockwise direction in FIG. 1) in coordination with the rotational driving of the pair of web drive rollers 50. A web conveyance motor 116 (shown in FIG. 4, and not shown in FIG. 1) drives the web drive rollers 50 to rotate, and the web conveyance motor 116 can also serve as a take-up motor to drive the take-up spindle to rotate. The take-up spindle of the take-up side web core 36 has a dual-tube structure, in which an outer tube is supported rotatably about the periphery of an inner tube. A torque limiter is arranged between the inner tube and the outer tube, and is composed in such a manner that when a load (torque) equal to or greater than a prescribed load is applied, the outer tube slides with respect to the inner tube. By this means, it is possible to prevent the wiping web 32 from being applied with excessive tension.

The pressing roller 40 is disposed horizontally, and one end of the spindle part of the pressing roller 40 is supported rotatably. The pressing roller 40 can be constituted of an elastic roller capable of elastic deformation, such as a rubber roller. The pressing roller 40 has a roller width corresponding to the width of the wiping web 32, and the pressing roller 40 is impelled in the upward direction in FIG. 1 by the impelling spring 42. Then, the wiping web 32 is impelled in the upward direction in FIG. 1 by the force of the impelling spring 42 through the pressing roller 40. When the wiping web 32 comes in contact with the nozzle face 22 of the head 20, the impelling spring 42 is elastically deformed or compressed, and the wiping web 32 is pressed with a prescribed pressure against the nozzle face 22 by the restoring force created by the elastic deformation of the impelling spring 42 and the restoring force created by the elastic deformation of the pressing roller 40.

The pair of web drive rollers 50 (corresponding to a "wiping member conveyance device") drives the wiping web 32 to be conveyed and is constituted of the pair of rollers arranged to face each other across the wiping web 32. The web conveyance motor 116 (shown in FIG. 4, and not shown in FIG. 1) is coupled to the pair of drive rollers 50, and the wiping web 32 pinched between the pair of drive rollers 50 is conveyed by driving the web conveyance motor 116. The pair of web drive rollers 50 is arranged in the vicinity of the take-up side web core 36, and the take-up spindle of the take-up side web core 36 is driven to rotate in coordination with the rotation of the pair of web drive rollers 50.

The wiping unit 30 is provided with a cleaning liquid deposition unit 60 before the pressing roller 40. The wiping unit 30 further includes in the conveyance path of the wiping web 32: a first guide roller 72, which guides the wiping web 32 paid out from the pay-out side web core 34 to the cleaning liquid deposition unit 60; and a second guide roller 76, which leads the wiping web 32 on which the cleaning liquid has been deposited by the cleaning liquid deposition unit 60, to the pressing roller 40.

The cleaning liquid deposition unit 60 includes a cleaning liquid deposition roller (transfer roller) 62. Although not shown in the drawings, the cleaning liquid deposition unit 60 further includes: a cleaning liquid tray (container), which stores the cleaning liquid; an anilox roller, which is partially immersed in the cleaning liquid contained in the cleaning liquid tray; a doctor blade, which is in contact with the anilox roller and removes excess liquid on the surface of the anilox roller; an intermediate roller, which rotates while being in contact with the anilox roller, and the like. The cleaning liquid held on the surface of the intermediate roller is transferred to the surface of the cleaning liquid deposition roller (transfer roller) 62. The anilox roller is a dosing roller in the surface of which a plurality of cells for holding the cleaning liquid are formed, and has a width corresponding to the width of the wiping web 32. The intermediate roller and the cleaning liquid deposition roller 62 also have widths corresponding to the width of the wiping web 32, and the cleaning liquid is supplied to the surface of the cleaning liquid deposition roller 62 through the anilox roller and the intermediate roller. The cleaning liquid deposition roller 62 is in contact with the wiping web 32 and rotates in the same direction as the conveyance direction of the wiping web 32. The cleaning liquid held on the surface of the cleaning liquid deposition roller (transfer roller) 62 is supplied to the wiping web 32. Consequently, the cleaning liquid is absorbed in the wiping web 32.

In the present embodiment, the application roller system is employed as the cleaning liquid supply device for the wiping web 32, but instead of this, it is also possible to employ a composition which deposits the cleaning liquid onto the wiping web 32 by spraying the cleaning liquid from a cleaning liquid spraying nozzle.

As described above, the wiping web 32 is provided in the state of rolled on the pay-out side web core 34, and can therefore be installed (replaced) in the wiping unit 30 in this state. More specifically, after the pay-out side web core 34 has been installed by fitting onto the pay-out spindle, the wiping web 32 is wrapped in sequence around the first guide roller 72, the second guide roller 76 and the pressing roller 40, and the take-up side web core 36 is fitted onto the take-up spindle, thereby completing installation.

By driving the pair of web drive rollers 50 to rotate, the wiping web 32 before wiping is paid out from the pay-out side web core 34. The wiping web 32 that has been paid out is conveyed successively through the first guide roller 72, the second guide roller 76 and the pressing roller 40, and is taken up onto and recovered on the take-up side web core 36.

Although not shown in FIG. 1, the liquid ejection apparatus 10 includes an elevator mechanism which is capable of raising and lowering the wiping unit 30 in the vertical direction in FIG. 1 (the direction of the z axis). With the elevator mechanism, it is possible to change the z-direction position of the wiping unit 30, and the height of the uppermost position 38 of the wiping web 32 wrapped around the pressing roller 40 can thereby be varied and adjusted.

The slack eliminating member 80 is a member that is arranged as a device for eliminating slack caused in the wiping web 32 upon the contact. The slack eliminating member 80 is arranged on the front side of the head 20 in the moving direction in which the head 20 is moved by the relative movement mechanism 90 (the forward direction indicated with the arrow A in FIG. 1) during the wiping operation. Moreover, the slack eliminating member 80 has a flat surface section 82, which is arranged to form the same plane with the nozzle face 22 of the head 20. The "same plane" referred to here is not limited to a case where the planes precisely coincide with each other, but includes a case where the planes are substantially the same and can be regarded as substantially the same plane, such as surfaces having a slight difference within the range of error in the mechanical installation accuracy.

The flat surface section 82 of the slack eliminating member 80 and the nozzle face 22 of the head 20 are connected continuously (without any large step differences) so as to be regarded as substantially the same plane. Then, when the object in contact with the wiping web 32 is switched from the slack eliminating member 80 to the nozzle face 22 of the head 20, a smooth sliding motion can be achieved with substantially no upward and downward movement of the pressing roller 40.

The slack eliminating member 80 can be composed so as to be installed on the head 20 as a component or member separate from the constituent parts of the head 20, or can be composed as to be installed on the head 20 as one of the constituent parts of the head 20. For instance, it is possible to compose the slack eliminating member 80 integrally with the head 20, by forming a slack eliminating region that functions as the flat surface section 82 of the slack eliminating member 80 on the nozzle plate constituting the nozzle face 22 of the head 20.

The wiping unit 30 is arranged in such a manner that, in a state before the wiping web 32 comes in contact with the slack eliminating member 80, the uppermost position 38 of the wiping web 32 wrapped around the pressing roller 40 is slightly (for example, by approximately 1.5 mm) higher than the position of the flat surface section 82 of the slack eliminating member 80 (i.e., the position of the nozzle face 22).

According to the present embodiment, with the movement of the head 20 by the relative movement mechanism 90, the wiping web 32 comes in contact with the slack eliminating member 80 before the wiping web 32 comes in contact with the nozzle face 22 (more specifically, the nozzle formation region where the nozzles are formed) of the head 20. Thereby, the slack of the wiping web 32 is eliminated while the wiping web 32 is in contact with the slack eliminating member 80, and the wiping web 32 of which the slack has been eliminated comes in contact with the nozzle face 22 and wipes the nozzle face 22.

<Description of Operation of Liquid Ejection Apparatus 10>

Next, a wiping and cleaning operation of the head 20 in the liquid ejection apparatus 10 composed as shown in FIG. 1 is described. When the nozzle face 22 of the head 20 is wiped and cleaned, the relative movement of the head 20 and the wiping unit 30 is carried out. During the wiping operation, when the head 20 is moved in the direction of the arrow A in FIG. 1, then with this relative movement, firstly, the slack eliminating member 80 comes in contact with the wiping web 32, and after the slack eliminating member 80 has passed over the wiping web 32, the nozzle face 22 (the nozzle formation region where the nozzles are formed) of the head 20 comes in contact with the wiping web 32.

Figure 2:
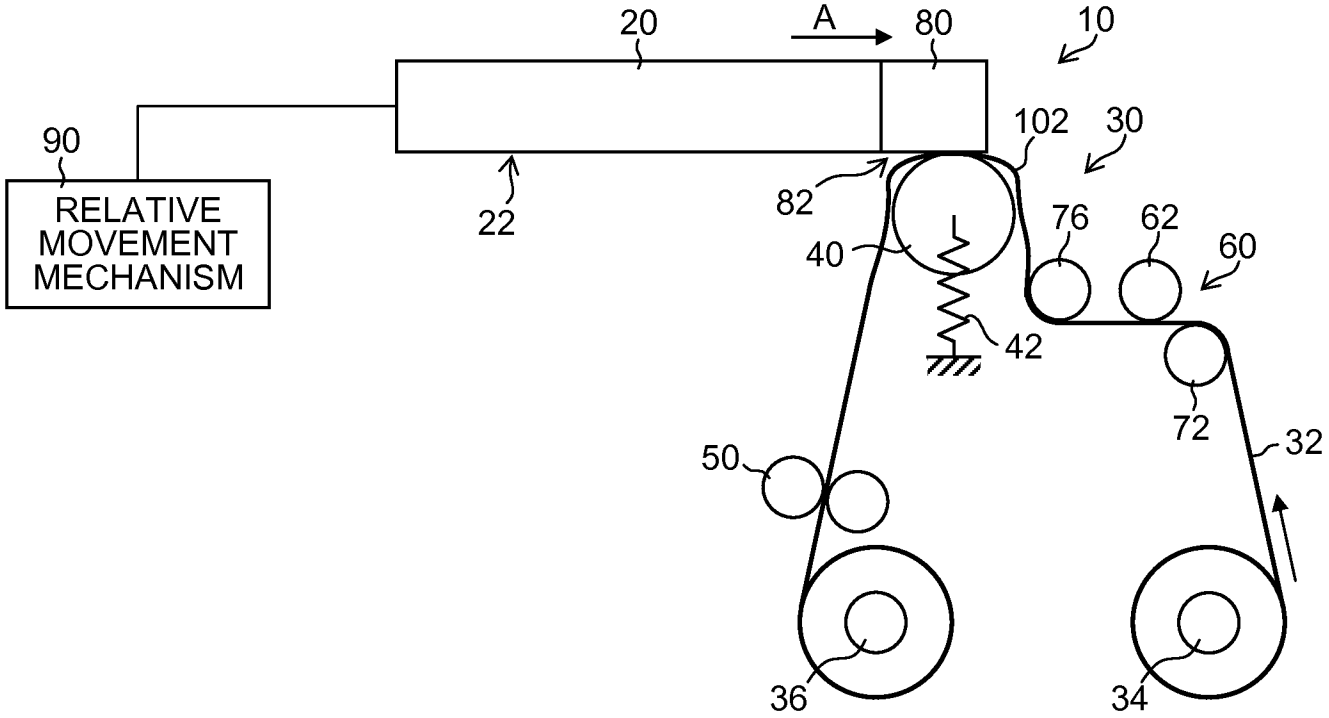
FIG. 2 is a schematic drawing showing a state where slack of a wiping web has occurred.

FIG. 2 is a schematic drawing showing a state where the wiping web 32 is in contact with the slack eliminating member 80 of the head 20. As illustrated in FIG. 1, in the state before the wiping web 32 comes in contact with the slack eliminating member 80, the uppermost position 38 of the wiping web 32 is situated at the position higher than the flat surface section 82 of the slack eliminating member 80, and therefore when the head 20 is moved in the direction of the arrow A and the slack eliminating member 80 comes over the pressing roller 40 as in FIG. 2, the pressing roller 40 is pressed down in accordance with the height differential (the overlap with the head 20), the impelling spring 42 is compressed, and the wiping web 32 comes in contact with the slack eliminating member 80.

When the wiping web 32 thereby comes in contact with the flat surface section 82 of the slack eliminating member 80 while the impelling spring 42 is compressed, then as shown in FIG. 2, slacks 102 of the wiping web 32 occur on both of the upstream side and the downstream side of the pressing roller 40. However, these slacks 102 are gradually absorbed or eliminated due to conveyance of the wiping web 32 by the driving of the web drive rollers 50. The slacks 102 are eliminated by the time that the flat surface section 82 of the slack eliminating member 80 has finished passing over the pressing roller 40 due to the relative movement of the head 20 and the wiping web 32 (during the period that the wiping web 32 is in contact with the slack eliminating member 80).

Figure 3:
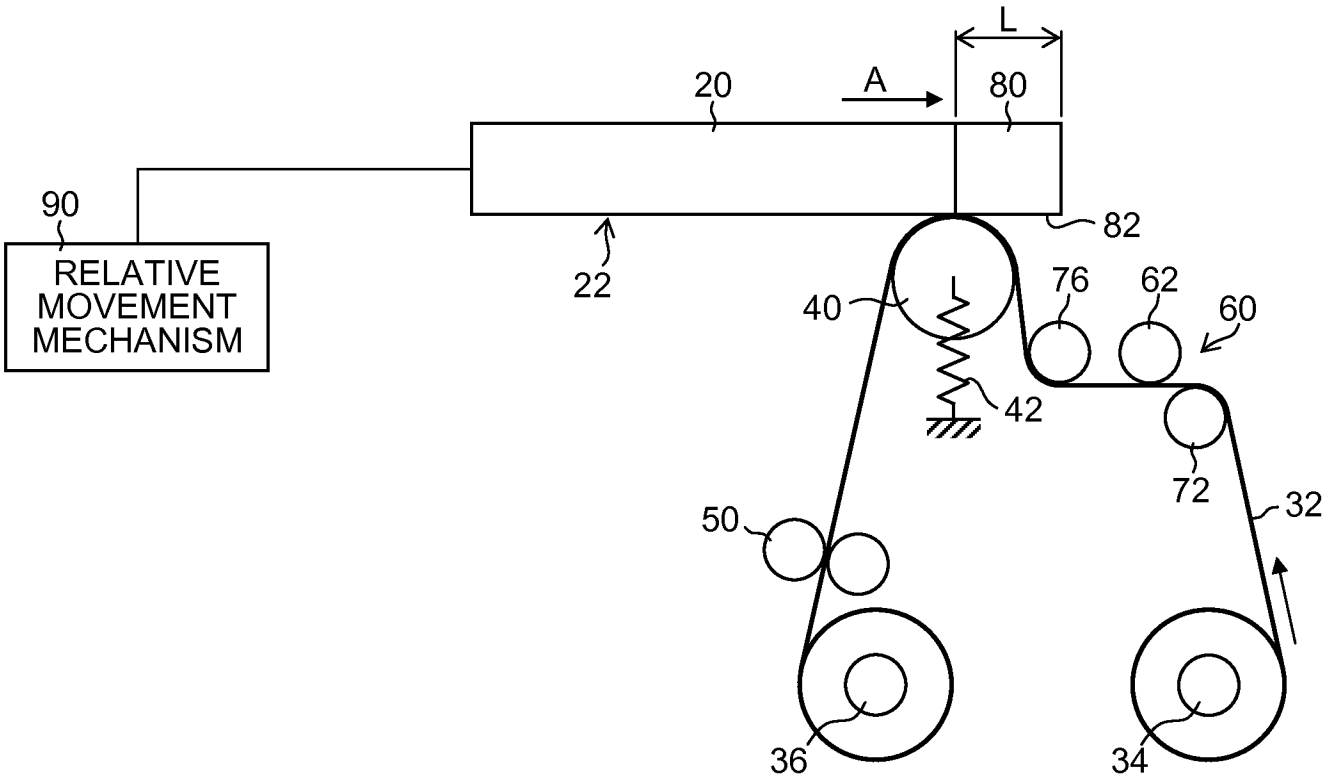
FIG. 3 is a schematic drawing showing a state where the slack of the wiping web has been removed.

Therefore, as shown in FIG. 3, the nozzle face 22 of the head 20 comes in contact with the wiping web 32 in a state where the slacks 102 have been eliminated (including a state where the slacks 102 have been reduced to an amount that presents substantially no problem), and the nozzle face 22 can be wiped with the wiping web 32 free of the slacks 102.

The flat surface section 82 of the slack eliminating member 80 is designed to have the size (the length L in the relative movement direction) so as to achieve a state where the slacks 102 are removed by the time that the wiping web 32 starts to wipe the nozzle face 22 of the head 20, while taking account of the amount of slacks 102 of the wiping web 32 generated upon the contact, the head movement speed (relative speed), and the web conveyance speed caused by the web drive rollers 50. The head movement speed and the web conveyance speed are specified by taking overall consideration of the physical properties of the wiping web 32, the properties of the cleaning liquid, the controllability of the relative movement mechanism 90, the productivity, the used amount of web, and so on; and in general, the web conveyance speed is set to a speed sufficiently smaller than the head movement speed (the relative movement speed). For example, the web conveyance speed is set to a speed not greater than 1/10 of the head movement speed. Desirably, the web conveyance speed is set to a speed not greater than 1/20 of the head movement speed.

For example, when the head movement speed is 80 mm/s and the web conveyance speed is 3.2 mm/s, it is possible to eliminate the slack (having the total amount of approximately 3 mm) of the wiping web 32 by installing the slack eliminating member 80 having the length L of 100 mm.

The faster the web conveyance speed caused by the drive of the web drive rollers 50, the greater the extent to which the time required for eliminating the slacks 102 can be shortened. However, if the web conveyance speed is raised, the used amount of the web increases accordingly. Therefore, from the viewpoint of suppressing the used amount of the web, as far as possible, it is desirable to suitably control the drive speed of the web drive rollers 50.

For example, it is possible to adopt control by which the web drive rollers 50 are driven at high speed only during a limited time while the wiping web 32 is in contact with the slack eliminating member 80, and is returned to normal driving (low-speed driving) after the slack has been eliminated. Alternatively, it is desirable that a sensor for detecting slack is employed, and switching between high-speed driving and normal driving is carried out by detecting the presence or absence of slack.

The head 20 is moved relatively, with respect to the wiping unit 30, in the direction opposite to the direction of travel of the wiping web 32 (the web conveyance direction), while the wiping web 32 from which the slacks have been eliminated is conveyed, and the nozzle face 22 is wiped and cleaned while the wiping web 32 is caused to slide over the nozzle face 22 of the head 20. The wiping position (contact position) of the wiping web 32 is changed sequentially by moving the head 20 relatively with respect to the wiping unit 30, and the whole area of the nozzle face 22 is sequentially wiped by the wiping web 32. During this relative movement, the wiping web 32 itself is also conveyed by the web drive rollers 50 and the contact region (wiping surface) of the wiping web 32 where the wiping web 32 is in contact with the nozzle face 22 is sequentially made new. Consequently, a new wiping surface of the wiping web 32 is constantly supplied to the wiping section.

According to the present embodiment, the head 20 is not wiped with a soiled surface of the wiping web 32 and therefore it is possible to improve the head cleaning properties. Thus, it is possible to improve the ejection stability from the head 20.

In the first embodiment shown in FIG. 1, a combination of the wiping unit 30, the slack eliminating member 80 and the relative movement mechanism 90 corresponds to a "cleaning apparatus for the liquid ejection head".

Second Embodiment

Figure 4:
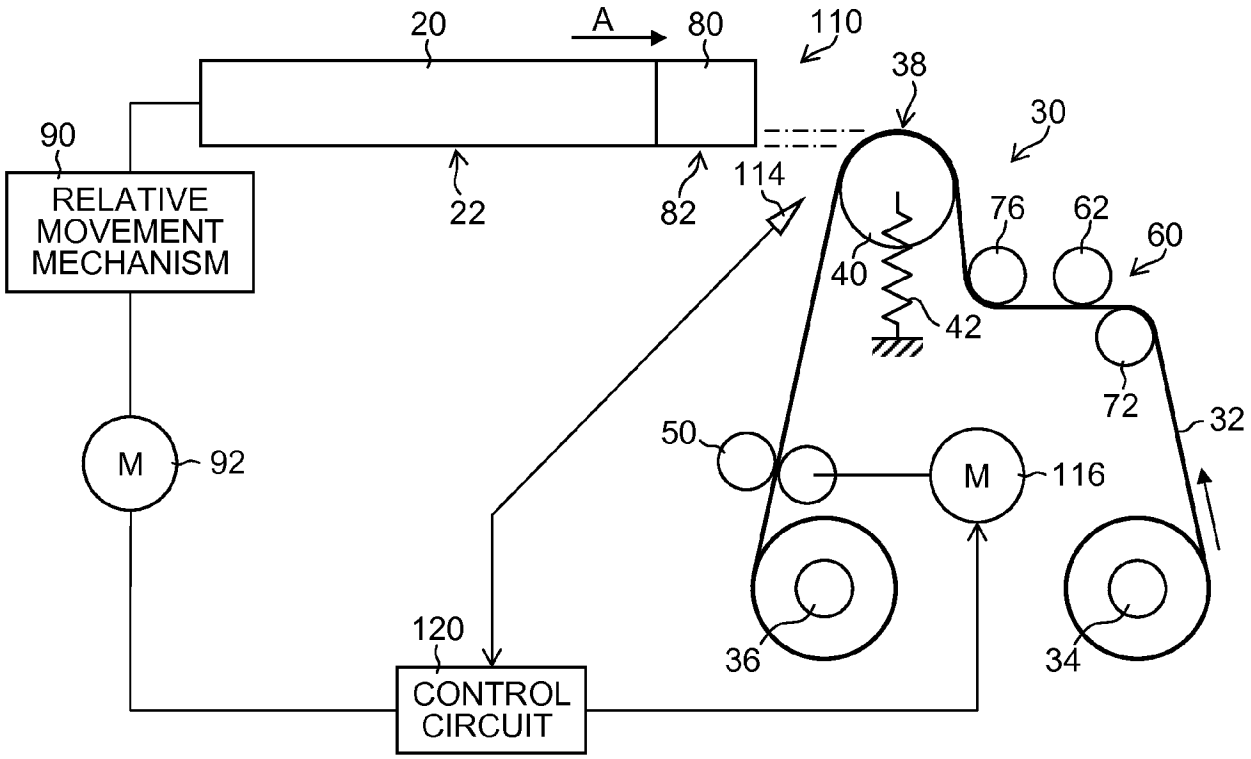
FIG. 4 is a schematic drawing showing a composition of a liquid ejection apparatus according to a second embodiment of the present invention.

FIG. 4 is a schematic drawing showing a composition of a liquid ejection apparatus 110 according to a second embodiment of the present invention. In FIG. 4, the elements which are the same as or similar to those in the first embodiment described with reference to FIGS. 1 to 3 are denoted with the same reference numerals, and description thereof is omitted here.

The liquid ejection apparatus 110 according to the second embodiment shown in FIG. 4 includes: a slack sensor 114 (corresponding to a "detection device"), which detects the slack 102 in the wiping web 32; and a control circuit 120 (corresponding to a "control device"), which controls driving of the web conveyance motor 116 according to a detection signal obtained from the slack sensor 114.

As a device for detecting the slack 102 of the wiping web 32, for example, it is possible to use a reflective type optical sensor, which irradiates the wiping web 32 with light from a light-emitting element, such as a laser or light-emitting diode (LED), for example, and receives the light reflected on the wiping web 32 with a light receiving element (photo-electric converting element). If there is no slack 102, then there is no reflected light from the wiping web 32, and if there is the slack 102, then the light reflected from the wiping web 32 in the portion of the slack 102 is received by the light receiving element, whereby an electrical signal corresponding to the amount of received light is obtained. By means of a composition of this kind, it is possible to detect the slack according to the presence or absence of reflected light from the wiping web 32. The detection signal obtained by the slack sensor 114 is sent to the control circuit 120.

The control circuit 120 can be constituted of a central processing unit (CPU) and peripheral circuits thereof. The control circuit 120 controls a motor (relative movement motor) 92, which forms the drive source of the relative movement mechanism 90, as well as controlling the web conveyance motor 116, which forms the drive source of the web drive rollers 50.

Figure 5:
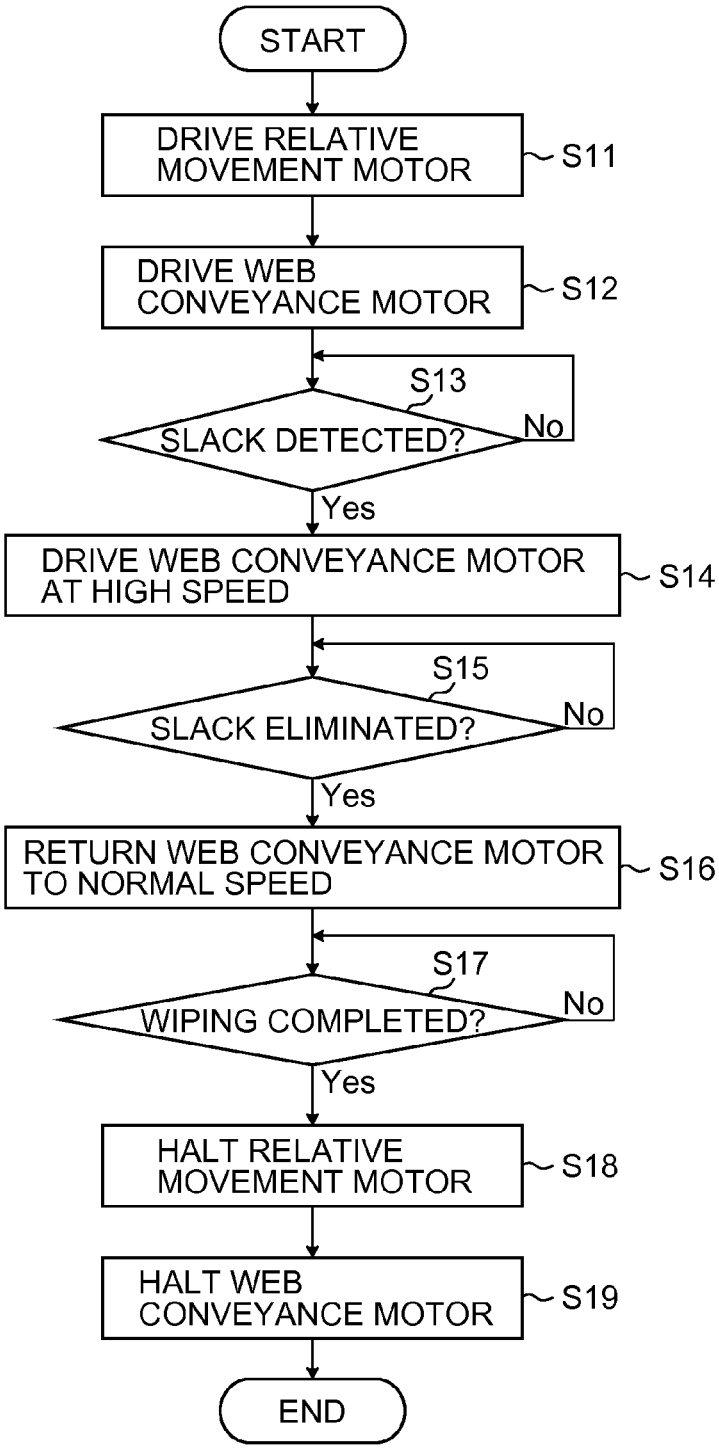
FIG. 5 is a flowchart showing a control procedure in the liquid ejection apparatus according to the second embodiment.

FIG. 5 is a flowchart showing an embodiment of a control procedure of the liquid ejection apparatus 110 according to the second embodiment. The operation of the liquid ejection apparatus 110 is described with reference to this flowchart.

When a wiping instruction to carry out wiping and cleaning is issued and the processing of the flowchart in FIG. 5 is started, firstly, the relative movement motor 92 is driven and the head 20 is moved toward the wiping unit 30 in the direction of arrow A in FIG. 4 (step S11). Simultaneously with the start of this movement, or at a suitable timing after the start of this movement, the driving of the web conveyance motor 116 is started (step S12). The drive speed in this case is the speed of normal driving, which achieves a conveyance speed (first conveyance speed) of the wiping web 32 when wiping the nozzle face 22. The control circuit 120 monitors the detection signal from the slack sensor 114 and judges whether or not slack of the wiping web 32 is detected (step S13).

Figure 6:
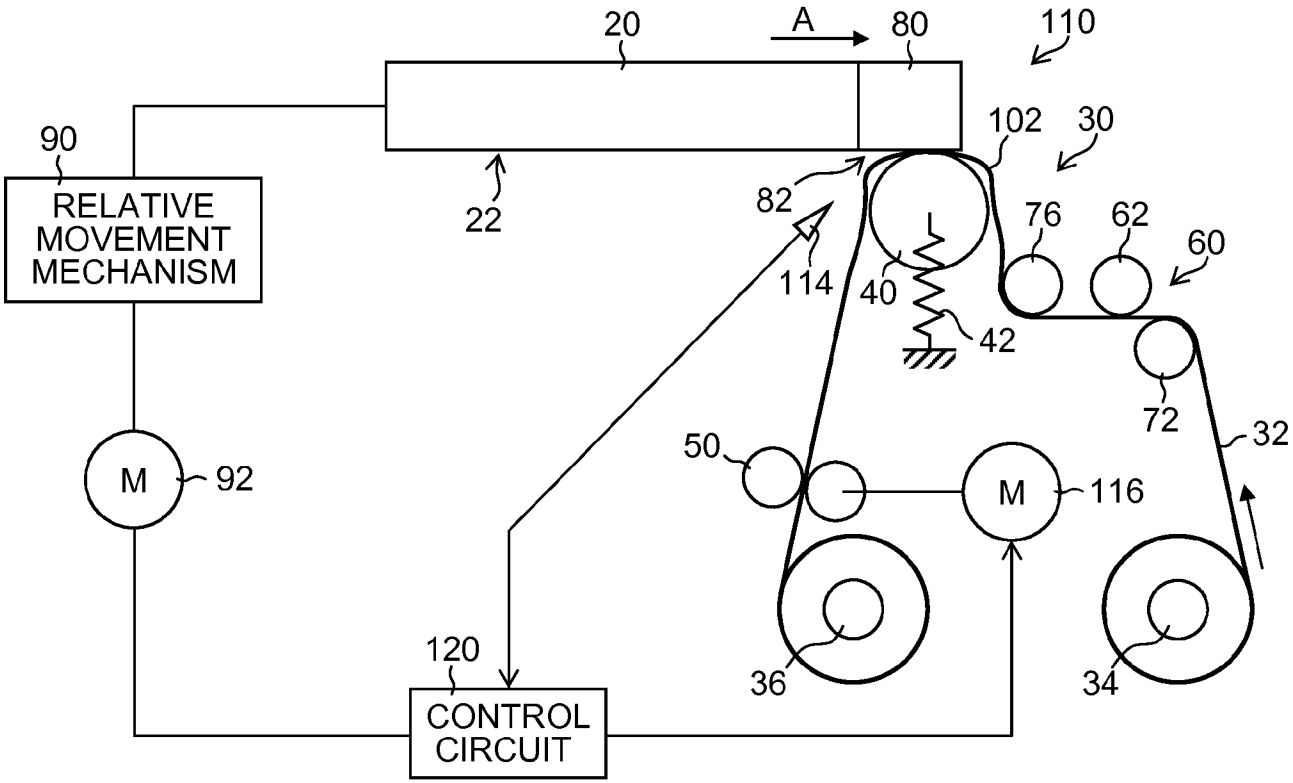
FIG. 6 is a schematic drawing showing a state where slack of the wiping web has occurred.

When the wiping web 32 comes in contact with the slack eliminating member 80 and the slack 102 caused by the contact is detected by the slack sensor 114 (see FIG. 6), the web conveyance motor 116 is driven at high speed (step S14 in FIG. 5). By driving the wiping web 32 at the higher speed than the normal speed, the slack 102 of the wiping web 32 is eliminated in a relatively short time. The control circuit 120 continues the monitoring of the detection signal from the slack sensor 114 and judges whether or not slack of the wiping web 32 is detected (step S15). When the slack 102 is eliminated and the slack sensor 114 ceases to detect slack 102, then control for returning the web conveyance motor 116 to the normal speed is carried out (step S16). The drive speed during the normal driving corresponds to the "first drive speed" and the drive speed during the high-speed driving corresponds to the "second drive speed".

Figure 7:
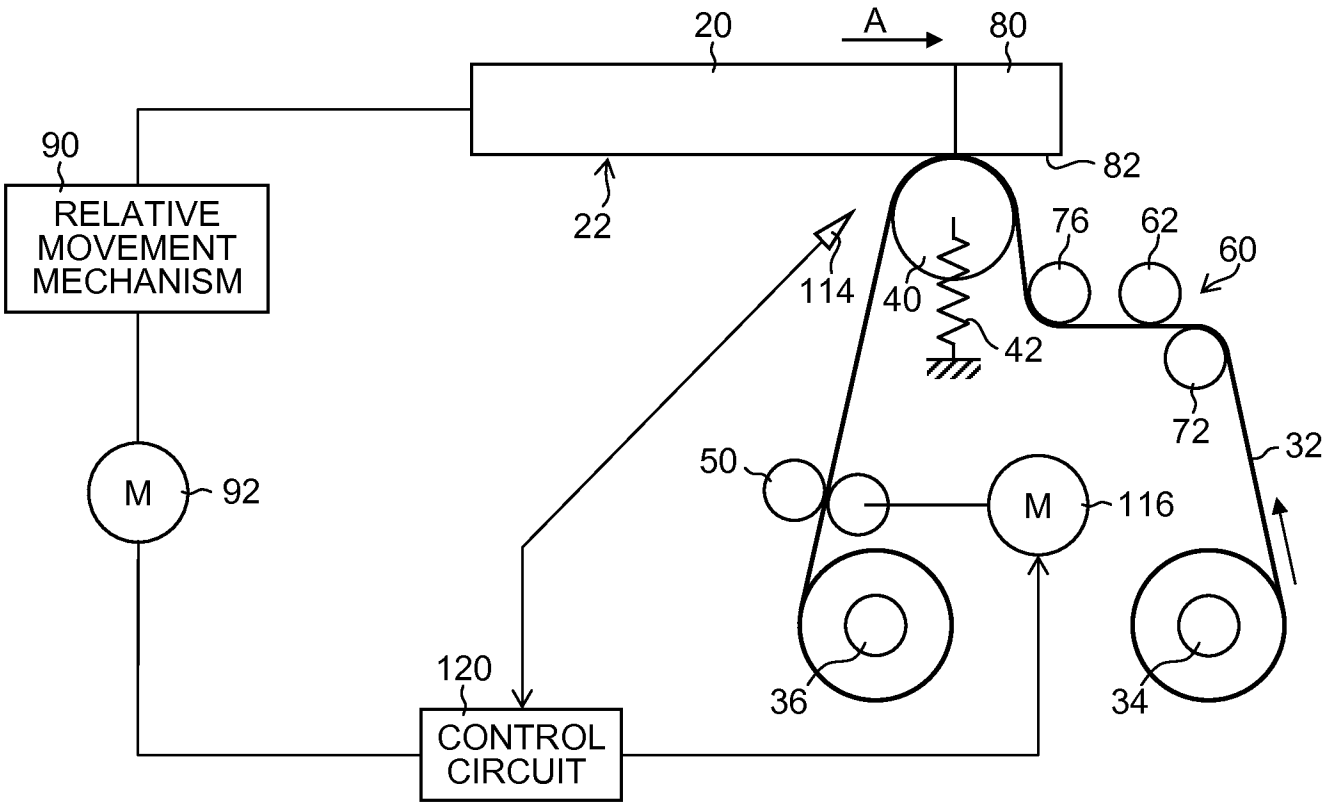
FIG. 7 is a schematic drawing showing a state where the slack of the wiping web has been removed.

Consequently, when the wiping web 32 comes in contact with the nozzle face 22 of the head 20, the slack 102 has been eliminated (see FIG. 7) and it is possible to start wiping of the nozzle face 22 in a state which is free of slack 102. Thereafter, the head 20 and the wiping unit 30 are moved relatively to each other while causing the wiping web 32 to travel at the normal speed, and the nozzle face 22 of the head 20 is wiped and cleaned.

Then, a judgment is made about whether or not wiping and cleaning of the whole area of the nozzle face 22 has been completed (step S17 in FIG. 5), and if it has not yet been completed, the operation of wiping and cleaning is continued. For example, it is possible to judge whether or not wiping and cleaning has been completed, on the basis of a signal from an encoder, or the like, which determines an amount of movement of the relative movement mechanism 90.

When the wiping and cleaning has been completed, the relative movement motor 92 is halted (step S18), and the web conveyance motor 116 is also halted (step S19). In this way, the wiping and cleaning process is completed.

Thereafter, when the head 20 is returned to the original position (image forming position), the wiping unit 30 is lowered until the wiping web 32 reaches a prescribed withdrawn position at a height where the wiping web 32 is not in contact with the head 20, and the head 20 is then moved in the direction reverse to the direction of arrow A.

According to the second embodiment, in addition to the action and beneficial effects obtained in the first embodiment, it is also possible to suppress the used amount of wiping web 32, as well as being able to shorten the time required for eliminating the slack of the wiping web 32. Furthermore, it is also possible to reduce the size of the slack eliminating member 80 (to shorten the length L thereof in the relative movement direction), in accordance with the shortening of the time required to eliminate the slack.

In the second embodiment, a combination of the relative movement mechanism 90 and the relative movement motor 92 corresponds to a "relative movement device", and a combination of the web drive rollers 50 and the web conveyance motor 116 corresponds to a "wiping member conveyance device".

<Modification Embodiment 1>

An alternative method to the second embodiment is one in which the slack sensor 114 is omitted and the web conveyance motor 116 is driven at high speed at the timing that the wiping web 32 comes in contact with the slack eliminating member 80. For example, it is possible to implement control by which the web conveyance motor 116 is driven at high speed from the time at which the wiping web 32 comes in contact with the slack eliminating member 80, and after a prescribed time period which is set previously as the time required to eliminate the slack has elapsed, the web conveyance motor 116 is returned to the normal speed (low-speed driving). In this case, in setting the prescribed time during which the high-speed driving is continued, the required time is investigated experimentally in accordance with various conditions, such as the web conveyance speed, the relative head speed, the amount of slack that occurs, and the like, and a suitable margin can be added.

According to this modification embodiment 1, similarly to the second embodiment, it is possible to eliminate the slack in a short time. However, the used amount of wiping web 32 is increased slightly in accordance with the lengthening of the high-speed driving time, compared to the case where the slack sensor 114 is used.

<Modification Embodiment 2>

In the first and second embodiments, the relative positioning of the head 20 and the wiping unit 30 in the height direction (z direction) is described in terms of raising and lowering the wiping unit 30 in the vertical direction; however, instead of this or in combination with this, it is also possible to use a mechanism that raises and lowers the head 20 in the vertical direction.

Embodiment of Application in Inkjet Recording Apparatus

Next, an embodiment is described in which the liquid ejection apparatus 10 or 110 described above is applied to an inkjet recording apparatus.

Figure 8:
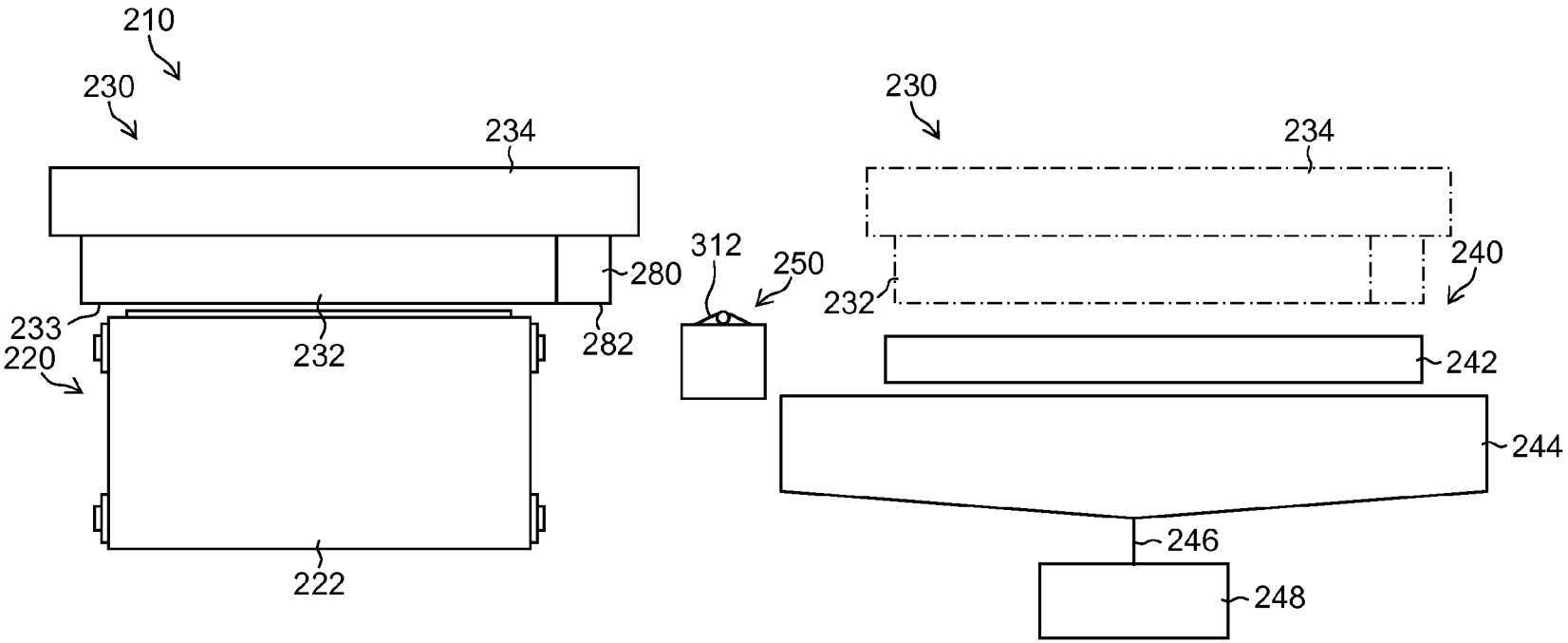
FIG. 8 is a front view diagram showing a composition of a principal part of an inkjet recording apparatus according to an embodiment of the present invention.
Figure 9:
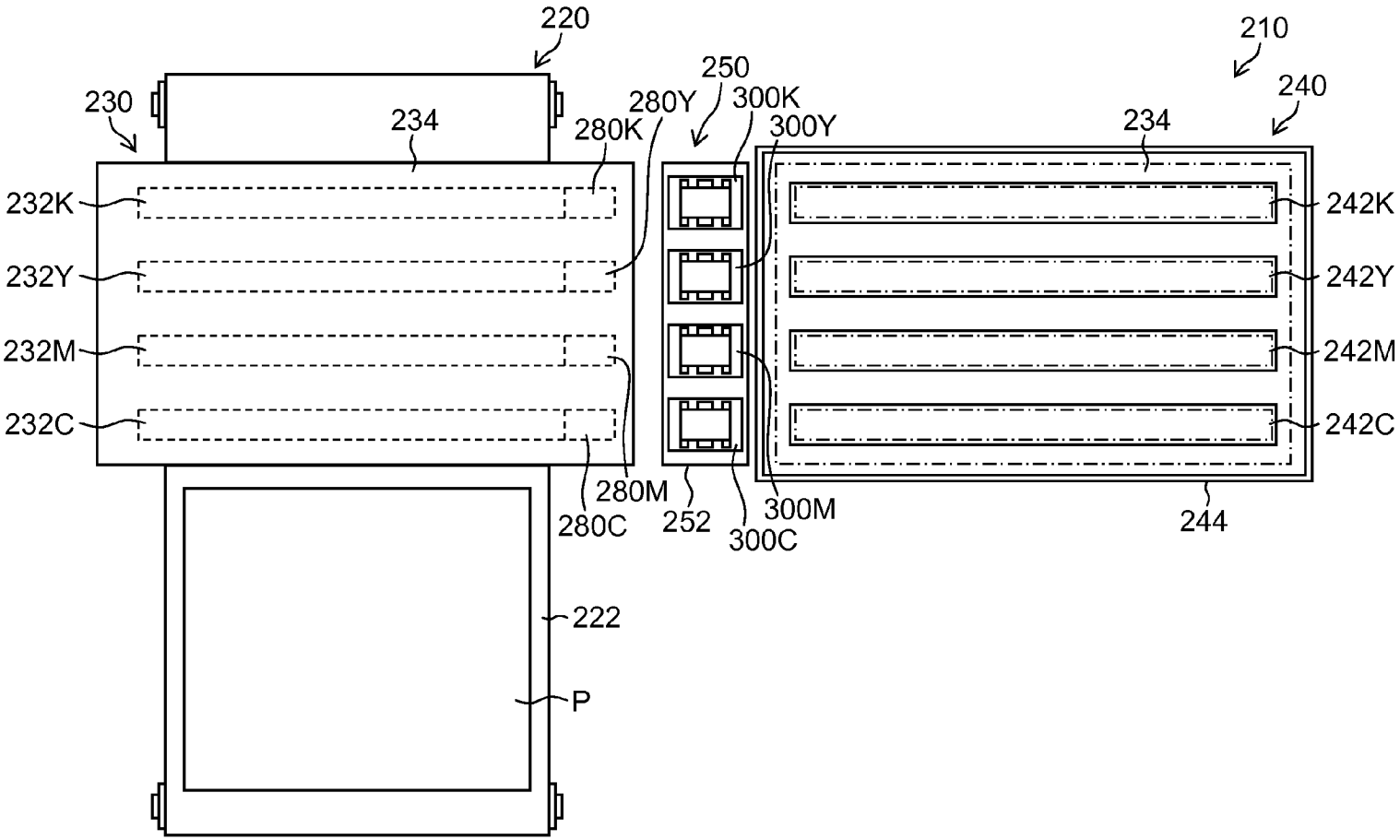
FIG. 9 is a plan view diagram of the inkjet recording apparatus in FIG. 8.
Figure 10:
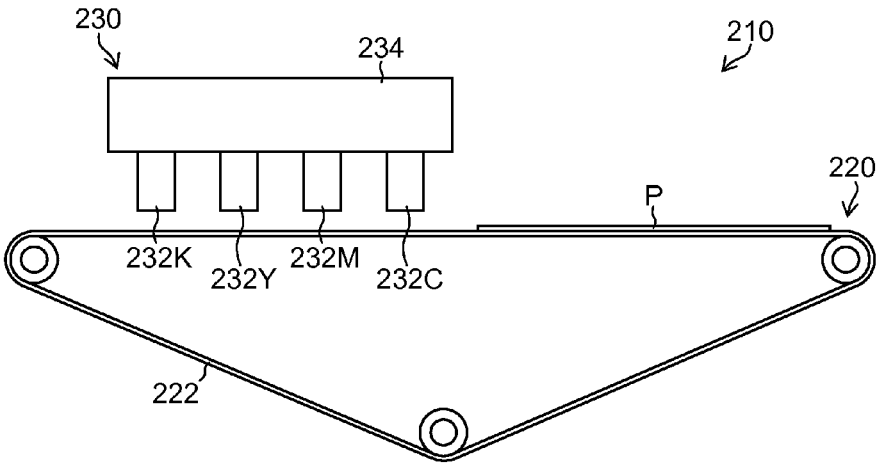
FIG. 10 is a side view diagram of the inkjet recording apparatus in FIG. 8.

FIGS. 8, 9 and 10 are a front view diagram, a plan view diagram and a side view diagram, respectively, showing a composition of the principal part of an inkjet recording apparatus 210 according to an embodiment of the present invention. As shown in FIGS. 8, 9 and 10, the inkjet recording apparatus 210 is a single-pass type of line printer, and includes: a paper conveyance mechanism 220 (which corresponds to a "medium conveyance device") configured to convey paper (cut sheet paper) P, which is a recording medium; a head unit 230, which ejects ink droplets of respective colors of cyan (C), magenta (M), yellow (Y) and black (K) toward the paper P which is conveyed by the paper conveyance mechanism 220; a maintenance unit 240, which carries out maintenance of heads 232 of the respective colors (corresponding to "liquid ejection heads") installed on the head unit 230; and a nozzle face cleaning apparatus 250, which cleans the nozzle faces of the respective heads 232 installed on the head unit 230. The head 232 in FIG. 8 corresponds to the head 20 in FIGS. 1 and 4, and the nozzle face cleaning apparatus 250 in FIG. 8 corresponds to the wiping unit 30 in FIGS. 1 and 4.

The paper conveyance mechanism 220 shown in FIG. 8 is constituted of a belt conveyance mechanism, and conveys the paper P holding the paper P on a conveyance face of a travelling belt 222 by suction.

As shown in FIG. 9, the head unit 230 includes: a head 232C, which ejects cyan (C) ink droplets; a head 232M, which ejects magenta (M) ink droplets; a head 232Y, which ejects yellow (Y) ink droplets; and a head 232K, which ejects black (K) ink droplets. The heads 232C, 232M, 232Y and 232K are constituted of line heads, which correspond to the maximum width of the paper P, which is the object of printing.

Furthermore, slack eliminating members 280C, 280M, 280Y and 280K are arranged on lateral sides of the heads 232C, 232M, 232Y and 232K, respectively. Since the heads 232C, 232M, 232Y and 232K equipped with the slack eliminating members 280C, 280M, 280Y and 280K have a common composition, then the following description refers to a slack eliminating member or members 280 and a head or heads 232, unless the particular ink colors are to be distinguished.

The slack eliminating member 280 is a member corresponding to the slack eliminating member 80 described with reference to FIG. 1. The slack eliminating member 280 has a flat surface section 282, which is arranged to form the same plane with the nozzle face 233 of the head 232.

The head unit 230 includes: a head supporting frame 234, on which the heads 232 are installed; and a head supporting frame movement mechanism (not shown), which moves the head supporting frame 234.

The head supporting frame 234 includes a head installation section (not shown) for installing the heads 232. The heads 232 are installed detachably in this head installation section. Furthermore, the head installation section is arranged so as to be raisable and lowerable on the head supporting frame 234, and is raised and lowered by an elevator mechanism (not shown). The heads 232 which are installed on the head installation section are raised and lowered perpendicularly with respect to the conveyance face of the paper P.

The heads 232 installed on the head supporting frame 234 are arranged perpendicularly with respect to the conveyance direction of the paper P. Furthermore, the heads 232 are arranged at a fixed interval apart in a prescribed order in the conveyance direction of the paper P. Although the configuration with the CMYK standard four colors is described in the present embodiment, combinations of the ink colors and the number of colors are not limited to those. As required, light inks, dark inks and/or special color inks can be added. For example, a configuration in which inkjet heads for ejecting light-colored inks such as light cyan and light magenta are added is possible. Moreover, there are no particular restrictions of the sequence in which the heads of respective colors are arranged.

The head supporting frame movement mechanism causes the head supporting frame 234 to slide horizontally in the direction perpendicular to the conveyance direction of the paper P above the paper conveyance mechanism 220. The "head supporting frame movement mechanism" corresponds to the "relative movement mechanism 90" in FIG. 1.

The head supporting frame movement mechanism includes, for example: a ceiling frame, which is disposed horizontally above the paper conveyance mechanism 220; guide rails, which are arranged on the ceiling frame; a traveling body, which slides over the guide rails; and a drive device, which moves the traveling body along the guide rails (for example, a screw feed mechanism, or the like). The head supporting frame 234 is installed on the travelling body and slides horizontally.

The head supporting frame 234 is driven by the head supporting frame movement mechanism, and is arranged movably between a prescribed "image recording position (image formation position)" and a "maintenance position". The head supporting frame 234 is arranged above the paper conveyance mechanism 220 when positioned at the image recording position. Thereby, it is possible to carry out printing onto the paper P conveyed by the paper conveyance mechanism 220.

On the other hand, the head supporting frame 234 is arranged at the position where the maintenance unit 240 is disposed when the head supporting frame 234 is situated at the maintenance position.

Caps 242 (242C, 242M, 242Y, 242K) configured to cover the nozzle faces 233 of the heads 232 are arranged in the maintenance unit 240. When the inkjet recording apparatus 210 is halted for a long period of time, for example, the heads 232 are moved to the position where the maintenance unit 240 is disposed (the maintenance position) and the nozzle faces 233 are covered with the caps 242. Thus, ejection failure due to drying is prevented.

A pressurizing and suctioning mechanism (not shown) for pressurizing and suctioning the interior of the nozzles and a cleaning liquid supply mechanism (not shown) for supplying cleaning liquid to the interior of the caps 242 are arranged in the caps 242. Furthermore, a waste liquid tray 244 is arranged at a position below the caps 242 (see FIG. 8). The cleaning liquid supplied to the caps 242 is discarded into the waste liquid tray 244 and is recovered into a waste liquid tank 248 from the waste liquid tray 244 through a waste liquid recovery pipe 246.

The nozzle face cleaning apparatus 250 is arranged between the paper conveyance mechanism 220 and the maintenance unit 240. The nozzle face cleaning apparatus 250 cleans the nozzle faces 233 by wiping the nozzle faces 233 of the heads 232 with wiping webs 312 when the head supporting frame 234 is moved from the image recording position to the maintenance position. Each of the wiping webs 312 corresponds to the wiping web 32 shown in FIG. 1.

The nozzle face wiping apparatus 250 includes: a wiping apparatus main body frame 252; wiping units 300C, 300M, 300Y and 300K, which are installed on the wiping apparatus main body frame 252; and a wiping apparatus main body elevator device (not shown), which raises and lowers the wiping apparatus main body frame 252.

The wiping units 300C, 300M, 300Y and 300K respectively make the wiping webs 312 in contact with the nozzle faces 233 of the heads 232 while causing the band-shaped wiping webs 312 to travel, thereby wiping the nozzle faces 233. The wiping units 300C, 300M, 300Y and 300K are arranged for the respective heads 232, and are arranged on the wiping apparatus main body frame 252 in accordance with the installation pitch of the heads 232. The wiping units 300C, 300M, 300Y and 300K all have the same composition and therefore the composition is described here with respect to one wiping unit, which is referred to as the wiping unit 300. The composition of the wiping unit 300 is similar to the composition of the wiping unit 30 described with reference to FIGS. 1 and 4.

<Embodiment of Composition of Head>

Figure 11:
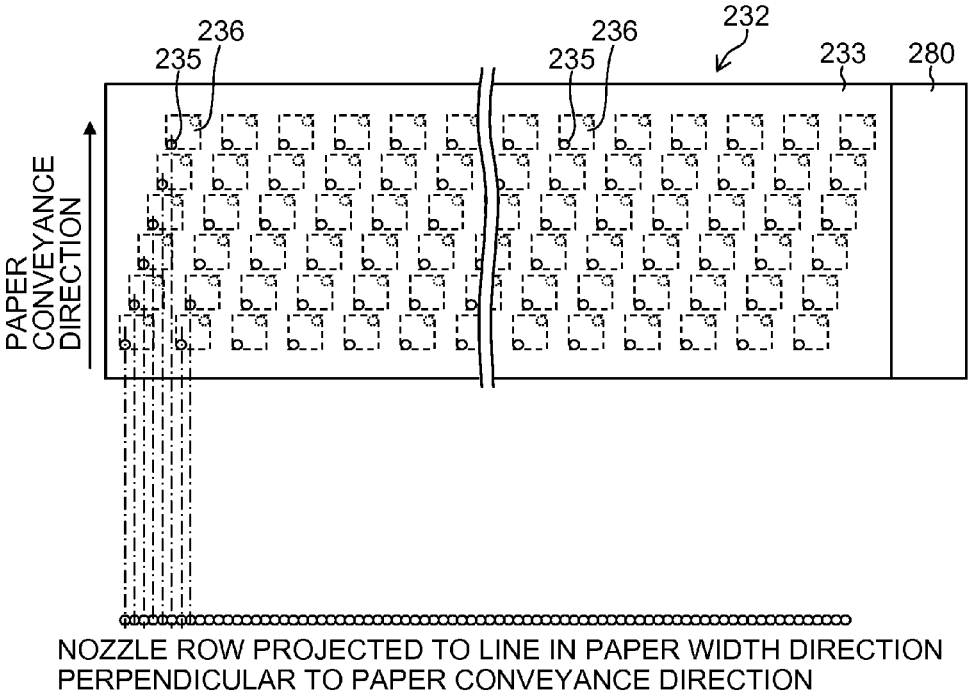
FIG. 11 is a plan view perspective diagram showing a composition of a head.
Figure 12:
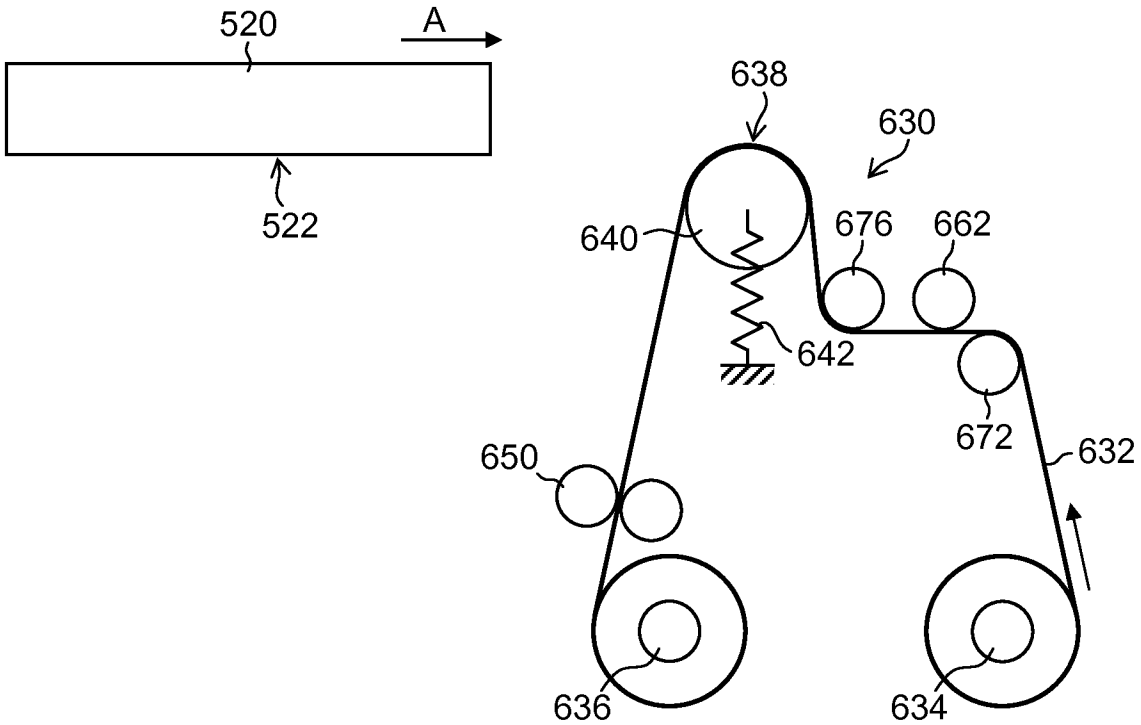
FIG.12 RELATED ART
FIG. 12 is a schematic drawing showing a composition of a cleaning apparatus which wipes a nozzle face of a head by means of a long wiping member in the related art.
Figure 13:
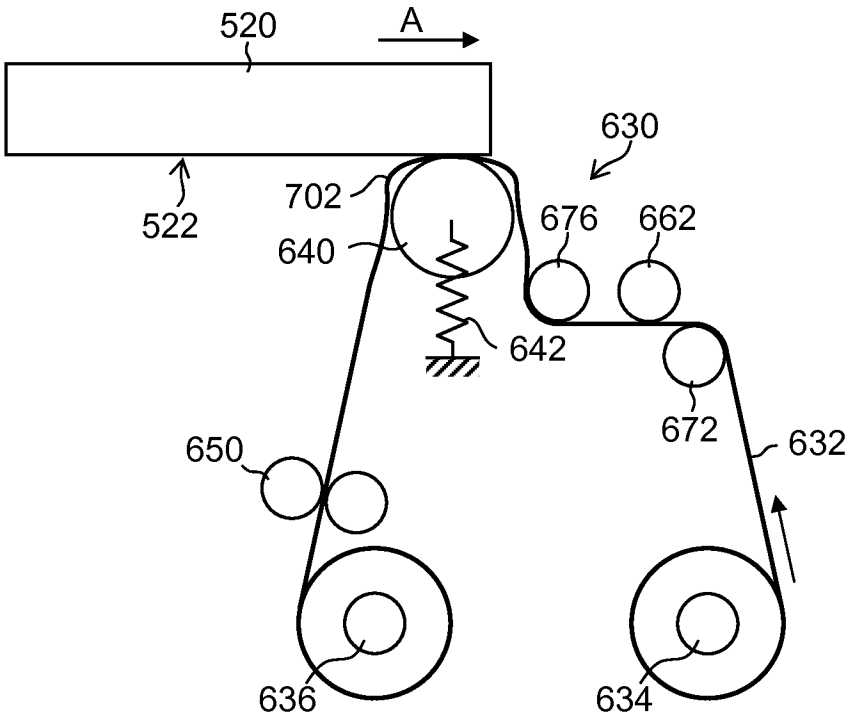
FIG.13 RELATED ART
FIG. 13 is a schematic drawing for describing a problem of reduced wiping ability due to slack of the wiping member in the related art.

FIG. 11 is a plan view perspective diagram of the head 232. A plurality of nozzles 235 configured to eject ink droplets are formed in the nozzle face 233 of the head 232. The head 232 according to the present embodiment is constituted of a so-called matrix head, in which the plurality of nozzles 235 are arranged in a two-dimensional matrix configuration. By adopting the composition in which the nozzles are arranged in the two-dimensional fashion on the nozzle face 233, it is possible to reduce the interval between the nozzles which are effectively arranged in the lengthwise direction of the head 232 (the paper width direction, which is perpendicular to the paper conveyance direction), and high recording resolution can be achieved.

In the case of the inkjet head (matrix head) having the two-dimensional nozzle arrangement, a projected nozzle row in which the nozzles in the two-dimensional nozzle arrangement are projected (by orthogonal projection) to an alignment in a direction (corresponding to a "main scanning direction") that is perpendicular to the medium conveyance direction (corresponding to a "sub-scanning direction") can be regarded as equivalent to a single nozzle row in which the nozzles are arranged at roughly even spacing at a nozzle density that achieves the recording resolution in the main scanning direction (the medium width direction). Here, "roughly even spacing" means substantially even intervals between the droplet deposition points which can be recorded by the inkjet printing system. For example, the concept of "even spacing" also includes cases where there is slight variation in the intervals, to take account of manufacturing errors or movement of the droplets on the medium due to landing interference. Taking account of the projected nozzle row (also referred to as the "effective nozzle row"), it is possible to associate the nozzle positions (nozzle numbers) in the alignment sequence of the projected nozzles which are aligned following the main scanning direction. In the description given below, reference to "nozzle positions" means the positions of the nozzles in the effective nozzle rows.

In implementing the present embodiment, the mode of arrangement of the nozzles 235 in the head 232 is not limited to the embodiment shown in FIG. 11, and it is possible to adopt various nozzle arrangements. For example, instead of the matrix arrangement shown in FIG. 11, it is possible to use a linear arrangement in one row, a V-shaped nozzle arrangement and a bent line-shaped nozzle arrangement such as a zig-zag shape (W shape, or the like) in which the V-shaped nozzle arrangement is repeated.

An image of a prescribed recording resolution (for example, 1200 dpi) can be recorded on an image formation region of the paper P (recording medium), by performing just one operation of relatively moving the paper P with respect to the head 232 provided with the nozzle row of this kind (in other words, by a single sub-scanning action).

<Ejection Method>

The head 232 according to the present embodiment ejects ink droplets from nozzles 235 by a so-called piezoelectric method. Each of the nozzles 235 is connected to a pressure chamber 236, and a droplet of ink is ejected from the nozzle 235 by causing a wall face of the corresponding pressure chamber 236 (for example, the upper face of the pressure chamber 236 when the ejection direction of droplet from the nozzle 235 is a downward direction) to vibrate by a piezoelectric element (not shown). The devices for generating ejection pressure (ejection energy) for ejecting the droplets from the nozzles in the inkjet head are not limited to the piezoelectric actuators (piezoelectric elements), and it is also possible to employ pressure generating elements (ejection energy generating elements) of various types, such as electrostatic actuators, heaters in a thermal method (a method which ejects ink by using the pressure created by film boiling upon heating by heaters) or actuators of various kinds based on other methods. A corresponding energy generating element is arranged in the flow channel structure in accordance with the ejection method of the head.

<Slack Eliminating Member>

The slack eliminating member 280 is arranged to the outside of the nozzle face 233 of the head 232 (on the front side in the direction of travel of the head 232 during the wiping), and the wiping web 312 of the nozzle face cleaning apparatus 250 (see FIGS. 8 and 9) comes in contact with the slack eliminating member 280 before the wiping web 312 comes in contact with the nozzle formation region of the head 232 (before the start of wiping of the nozzle face 233). Consequently, it is possible to eliminate any slack in the wiping web 312 that occurs upon the contact, by means of the slack eliminating member 280.

<Nozzle Face Cleaning Operation>

The nozzle face cleaning apparatus 250 wipes the respective nozzle faces 233 by causing the wiping webs 312 to slide over the nozzle faces 233 of the heads 232 while causing the wiping webs 312 to travel, during the course of the movement of the heads 232 from the image recording position to the maintenance position.

The nozzle face cleaning apparatus 250 is situated at a prescribed standby position when cleaning is not being performed, and during the cleaning, is situated at a prescribed operating position, which is raised by a prescribed amount with respect to the standby position. Furthermore, when the nozzle face cleaning apparatus 250 is situated in the prescribed operating position, it is possible to wipe the nozzle faces 233 with the wiping units 300. In other words, the wiping webs 312 can come in contact and pressed against the nozzle faces 233 when the heads 232 pass over the wiping units 300.

When a nozzle face cleaning instruction is applied and the inkjet recording apparatus 210 enters into nozzle face cleaning mode, the heads 232 are moved from the image recording position to the maintenance position. When the heads 232 reach the prescribed positions, the wiping webs 312 are conveyed in the direction opposite to the direction of travel of the heads 232. The slack that occurs when each wiping web 312 comes in contact with the slack eliminating member 280 is eliminated while the wiping web 312 is in contact with the slack eliminating member 280, and then the wiping web 312 comes in contact with the nozzle face 233 in a state where the slack has been eliminated. By wiping the nozzle faces 233 through causing the wiping webs 312 to travel in the direction opposite to the direction of movement of the nozzle faces 233, it is possible to wipe the nozzle faces 233 efficiently. Furthermore, it is also possible to wipe each nozzle face 233 always using a new surface (unused region) of the wiping web 312.

<Further Modification Embodiment>

In the embodiments described above, the inkjet recording apparatus using the page-wide full-line type heads having the nozzle rows of the lengths corresponding to the full width of the recording medium (the single-pass image forming apparatus, which completes an image by a single sub-scanning action) has been described; however, the application of the present invention is not limited to this, and the present invention can also be applied to an inkjet recording apparatus which performs image recording by means of a plurality of scanning actions over a recording medium by moving a short recording head, such as a serial head (shuttle scanning head), or the like.

<Head Movement Direction During Wiping and Cleaning>

In the embodiments described above, the nozzle face is wiped and cleaned while the head is moved from the image recording position to the maintenance position; however, instead of this or in combination with this, it is also possible to wipe and clean the nozzle face during the movement of the head from the maintenance position to the image recording position.

Moreover, in the embodiments described above, the wiping member has the width corresponding to the width of the nozzle face of the head in the breadthwise direction, and the nozzle face is wiped in the lengthwise direction; however, the wiping direction is not limited to this direction. For example, it is also possible that a wiping member that has the width corresponding to the length of the nozzle face in the lengthwise direction is used to wipe the nozzle face in the breadthwise direction.

In either of these modes, the slack eliminating member is arranged to the outside of the nozzle formation region, taking account of the relative movement direction of the head with respect to the wiping member, in such a manner that the wiping member comes in contact with the slack eliminating member before the wiping member comes in contact with the nozzle face of the head (the nozzle formation region).

<Device for Causing Relative Movement of Head and Recording Medium>

In the embodiments described above, the embodiments are given in which the recording medium is conveyed with respect to the stationary head, but in implementing the present invention, it is also possible to move a head with respect to a stationary recording medium (image formation receiving medium), or move both of the head and the recording medium.

The full line type recording head based on the single pass method is normally arranged in the direction perpendicular to the feed direction (conveyance direction) of the recording medium; however, a mode is also possible in which the head is arranged in an oblique direction forming a certain prescribed angle with respect to the direction perpendicular to the conveyance direction. In this case also, it is possible to specify the effective nozzle row direction, and the like, by defining two mutually intersecting axes (a first direction and a second direction).

Furthermore, in the embodiments described above, the paper conveyance mechanism 220 based on the belt conveyance method is given as an example of the medium conveyance device; however, the conveyance method is not limited to the belt conveyance method and it is also possible to adopt a drum conveyance method, which conveys a recording medium by wrapping the recording medium around the circumferential surface of the drum.

<Orientation of Nozzle Face>

In the embodiments described above, the nozzle face of the head is taken to be in the horizontal plane, and the droplet ejection direction is taken to be the vertically downward direction; however, it is also possible to adopt a composition in which the nozzle face of the head is inclined at a prescribed angle with respect to the horizontal plane. In this case, the contacting surface of the wiping web is also inclined in accordance with the inclination of the nozzle face. Furthermore, a composition is adopted in which the flat surface section of the slack eliminating member is arranged to form the same plane with the nozzle face.

<Recording Medium>

The "recording medium" is a general term for a medium on which dots are recorded by droplets ejected from the liquid ejection head, and this includes various terms, such as print medium, recorded medium, image formation medium, image receiving medium, deposition receiving medium, print sheet, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, nonwoven cloth, a printed substrate on which a wiring pattern, or the like, is formed, or a rubber sheet.

Application Examples of the Apparatus

In the embodiments described above, application to the inkjet recording apparatus for graphic printing has been described, but the scope of application of the present invention is not limited to this. For example, the present invention can also be applied widely to inkjet apparatuses which obtain various shapes or patterns using liquid function material, such as a wire printing apparatus for forming an image of a wire pattern for an electronic circuit, manufacturing apparatuses for various devices, a resist printing apparatus using resin liquid as a functional liquid for ejection, a color filter manufacturing apparatus, a fine structure forming apparatus for forming a fine structure using a material for material deposition, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head which has a liquid ejection face formed with nozzles configured to eject droplets of liquid;

a long wiping member which is configured to come in contact with the liquid ejection face to wipe the liquid ejection face;

a wiping member conveyance device which is configured to drive the wiping member to be conveyed in a lengthwise direction of the wiping member;

a control device which is configured to control a drive speed of the wiping member conveyance device to drive the wiping member;

a pressing member which is configured to cause the wiping member to come in contact and pressed against the liquid ejection face;

an elastic member which is configured to elastically deform and apply a force to cause the wiping member to be pressed against the liquid ejection face through the pressing member when the wiping member comes in contact and pressed against the liquid ejection face;

a relative movement device which is configured to cause relative movement of the liquid ejection head with respect to the wiping member that is in contact with the liquid ejection head and travels by being driven to be conveyed by the wiping member conveyance device; and a slack eliminating member which is arranged in a front side of the liquid ejection head in a direction of travel of the liquid ejection head with respect to the wiping member caused by the relative movement, the slack eliminating member being configured to eliminate slack in the wiping member caused by elastic deformation of the elastic member when the wiping member comes in contact with the slack eliminating member, wherein:

the wiping member conveyance device is configured to drive the wiping member to be conveyed to eliminate the slack when the wiping member is in contact with the slack eliminating member; and the control device is configured to cause the wiping member conveyance device to drive at a first drive speed when the liquid ejection face is wiped by the relative movement while the wiping member is in contact with the liquid ejection face, and is configured to cause the wiping member conveyance device to drive at a second drive speed faster than the first drive speed when the wiping member is in contact with the slack eliminating member.

2. The liquid ejection apparatus as defined in claim 1, wherein the slack eliminating member has a flat surface section which is arranged to form a same plane with the liquid ejection face of the liquid ejection head.

3. The liquid ejection apparatus as defined in claim 1, further comprising:

a detection device which is configured to detect the slack, wherein the control device is configured to control the drive speed of the wiping member conveyance device in accordance with a detection signal obtained from the detection device.

4. The liquid ejection apparatus as defined in claim 3, wherein the control device is configured to cause the wiping member conveyance device to drive at the second drive speed when the slack is detected by the detection device, and is configured to cause the wiping member conveyance device to drive at the first drive speed when the slack ceases to be detected by the detection device.

5. The liquid ejection apparatus as defined in claim 1, wherein:

the wiping member is wound around a first core on a pay-out side; and the wiping member conveyance device is configured to drive the wiping member to be paid out from the first core, to pass through the pressing member, and to be taken up onto a second core on a take-up side.

6. The liquid ejection apparatus as defined in claim 1, wherein the wiping member conveyance device is configured to drive the wiping member to be conveyed in a direction opposite to a direction of the relative movement of the liquid ejection head with respect to the wiping member caused by the relative movement device.

7. The liquid ejection apparatus as defined in claim 1, wherein a conveyance speed of the wiping member caused by the wiping member conveyance device is less than 1/10 of a speed of the relative movement of the liquid ejection head with respect to the wiping member caused by the relative movement device.

8. The liquid ejection apparatus as defined in claim 1, wherein in a state before the wiping member comes in contact with the slack eliminating member, an uppermost position of the wiping member wrapped around the pressing member is higher than a position of the liquid ejection face.

9. A cleaning apparatus for a liquid ejection head, comprising:

a long wiping member which is configured to come in contact with a liquid ejection face of a liquid ejection head to wipe the liquid ejection face, the liquid ejection face being formed with nozzles configured to eject droplets of liquid;

a wiping member conveyance device which is configured to drive the wiping member to be conveyed in a lengthwise direction of the wiping member;

a control device which is configured to control a drive speed of the wiping member conveyance device to drive the wiping member;

a pressing member which is configured to cause the wiping member to come in contact and pressed against the liquid ejection face;

an elastic member which is configured to elastically deform and apply a force to cause the wiping member to be pressed against the liquid ejection face through the pressing member when the wiping member comes in contact and pressed against the liquid ejection face; and a slack eliminating member which is arranged in a front side of the liquid ejection head in a direction of travel of the liquid ejection head with respect to the wiping member to wipe the liquid ejection face caused by relative movement of the liquid ejection head with respect to the wiping member that is in contact with the liquid ejection head and travels by being driven to be conveyed by the wiping member conveyance device, the slack eliminating member being configured to eliminate slack in the wiping member caused by elastic deformation of the elastic member when the wiping member comes in contact with the slack eliminating member, wherein:

the wiping member conveyance device is configured to drive the wiping member to be conveyed to eliminate the slack when the wiping member is in contact with the slack eliminating member; and the control device is configured to cause the wiping member conveyance device to drive at a first drive speed when the liquid ejection face is wiped by the relative movement while the wiping member is in contact with the liquid ejection face, and is configured to cause the wiping member conveyance device to drive at a second drive speed faster than the first drive speed when the wiping member is in contact with the slack eliminating member.

10. An inkjet recording apparatus, comprising:

a liquid ejection head which has a liquid ejection face formed with nozzles configured to eject droplets of liquid;

a medium conveyance device which is configured to convey a recording medium on which the droplets ejected from the liquid ejection head are deposited;

the cleaning apparatus as defined in claim 9; and a relative movement device which is configured to cause the relative movement of the liquid ejection head with respect to the wiping member that is in contact with the liquid ejection head and travels by being driven to be conveyed by the wiping member conveyance device.

11. The inkjet recording apparatus as defined in claim 10, wherein a plurality of the liquid ejection heads are arranged in a conveyance path of the recording medium, and the cleaning apparatus is arranged for each of the liquid ejection heads.

12. The cleaning apparatus as defined in claim 9, wherein in a state before the wiping member comes in contact with the slack eliminating member, an uppermost position of the wiping member wrapped around the pressing member is higher than a position of the liquid ejection face.

* * * * *